US007681368B1

(12) United States Patent
Rubio

(10) Patent No.: US 7,681,368 B1
(45) Date of Patent: Mar. 23, 2010

(54) CONCRETE COMPOSITE WALL PANEL

(76) Inventor: Edward Rubio, 100 Cromwell Ct., Raleigh, NC (US) 27614

( * ) Notice: Subject to any disclaimer, the term of this patent is extended or adjusted under 35 U.S.C. 154(b) by 87 days.

(21) Appl. No.: 11/842,182

(22) Filed: Aug. 21, 2007

(51) Int. Cl.
*E04C 2/04* (2006.01)

(52) U.S. Cl. ..... 52/309.12; 52/309.7; 52/309.9; 256/31

(58) Field of Classification Search ..... 52/309.7, 52/309.9, 309.11, 309.12, 309.16, 309.17, 52/309.2, 794.1
See application file for complete search history.

(56) References Cited

U.S. PATENT DOCUMENTS 3,313,073 A * 4/1967 Mathews ..... 52/309.2
4,649,682 A * 3/1987 Barrett, Jr. ..... 174/480
5,184,808 A * 2/1993 Vesper ..... 256/31
5,265,389 A * 11/1993 Mazzone et al. ..... 52/309.7
5,758,463 A * 6/1998 Mancini, Jr. ..... 52/309.12
6,026,629 A * 2/2000 Strickland et al. ..... 52/794.1
6,263,628 B1 * 7/2001 Griffin ..... 52/309.12
6,519,904 B1 * 2/2003 Phillips ..... 52/309.12
6,698,150 B1 * 3/2004 DiLorenzo ..... 52/414
6,729,090 B2 * 5/2004 Messenger et al. ..... 52/309.12
6,886,301 B2 * 5/2005 Schilger ..... 52/302.1
7,562,500 B2 * 7/2009 Siu ..... 52/236.6
2002/0069600 A1 * 6/2002 Bryant ..... 52/309.9
2006/0201090 A1 * 9/2006 Guevara et al. ..... 52/309.12
2007/0107341 A1 * 5/2007 Zhu ..... 52/309.12

* cited by examiner

*Primary Examiner*—Richard E Chilcot, Jr.
*Assistant Examiner*—Alp Akbasli
(74) *Attorney, Agent, or Firm*—Ishman Law Firm P.C.

(57) ABSTRACT

A composite wall panel for exterior walls of a structure includes a polymeric foam core having a C-stud framing system embedded therein and an exterior and/or interior facing formed of a reinforced concrete bonded to the core surface and mechanically attached to the studs thereby providing increased strength, insulation and resistance to environmental conditions.

5 Claims, 8 Drawing Sheets

CONCRETE COMPOSITE WALL PANEL

FIELD OF THE INVENTION

The present invention relates to insulated walls and, in particular, to a concrete faced insulated wall panel for load bearing exterior building walls.

BACKGROUND OF THE INVENTION

Exterior load bearing walls for residential and commercial structures generally comprise field built framing, wood or steel, to which an exterior facing such as wood, vinyl or aluminum siding, brick or masonry veneer is field applied. After insulating the frame cavities, an interior facing is also field applied. The materials for such construction and the tools and the skilled personnel for erection are readily available. While hybrid walls have been proposed, the industry has been resistant to change.

The load bearing strength of such walls is based entirely on the framing members in accordance with applicable codes with the contribution of the other wall components not taken into account, thus dictating wall thickness. The wall thickness in turn limits the insulation and accordingly the R-value of the wall system. The framing also provides a direct high conductivity thermal path between the insulation areas. Further, the exterior facings are subject to destructive damage under extreme climate conditions including hurricanes, blizzards, tornadoes and the like. Notwithstanding these deficiencies, these walls remain the wall systems of choice for the construction industry.

It would in view of the above be desirable to provide an improved exterior wall system that resists to environmental damage, provides increased load bearing capability, increases the insulation value for savings in heating in heating and cooling, and uses materials and trade skills accepted by the construction industry.

SUMMARY OF THE INVENTION

This present invention provides a load bearing exterior wall based on metal framing encased in foam core having an exterior composite surface of concrete embedded in reinforcing mesh attached to the frame, and an interior surface of a concrete composite or conventional facing. The wall uses the framing and masonry skills and tools of current personnel and enables construction in a manufacturing facility for savings in time and labor. The exterior walls are formed of multiple panels with framed openings for doors and windows and can be transported to the construction site for erection. The foam core is formed of a polymeric foam block, preferably expanded polystyrene, having vertical slots formed therein providing conformal pockets for telescopic insertion of metal C-studs. The slot surfaces abut the entire periphery of the studs thereby resisting deflection along the stud length and increasing the load bearing strength. Spaced slots are formed in the top and bottom of the core for receiving framing tracks attached to the studs conventionally by fasteners and forming the upper and lower frame walls for attachment to adjacent building structure. The tracks may be an extending length for assembling multiple panels. Door and window openings are formed with conventional framing members and the foam removed from the openings. The studs are thus spaced from the outer core surface by foams, providing thermal breaks and increasing the R-value of the wall.

A concrete reinforcing mesh is attached by headed fasteners against the foam core and mechanically to the side walls of the studs at the exterior surface and optionally the inner surface. Preferably, assembly to this stage is done in a factory setting to maximize construction efficiency and cost. The panel is placed on a horizontal work surface and the panel perimeter dammed with concrete forms. Concrete is applied to the surface to a depth embedding the mesh and bonding to the core surface thus providing a composite layer further increasing wall strength. If a concrete facing is desired on the interior surface, after curing of the exterior concrete layer, the panel is inverted and the process repeated on the interior side. The interior surface conventionally applied after erection. The complete wall section is lighter in weight than masonry walls and may be hoisted into place by light weight lifting equipment. The completed exterior has superior resistance to environmental conditions including hurricane force winds and rain, seismic waves, insects infestation, salt spray, moisture intrusion, acoustical transmission, and the like as well as superior fire resistance.

Accordingly, it is an object of the invention to provide an improved exterior wall panel with improved strength and insulation with a composite exterior layer of concrete.

Another object is to provide an exterior load bearing wall having a metal framing system embedded in a foam core with a composite layer of concrete and reinforcing mesh attached thereto.

A further object is to provide an exterior load bearing material of improved strength and insulation using conventional materials and skills for construction.

Yet another object is to provide a wall section comprising a plurality of polymeric foam panels having interior slots structurally encasing a C-stud framing system and having an exterior and/or interior reinforced concrete layer bonded to the foam panels and mechanically attached to the framing.

BRIEF DESCRIPTION OF THE DRAWINGS

The above and other advantages of the present invention will become apparent upon reading the following written description taken in conjunction with the accompanying drawings in which.

DETAILED DESCRIPTION OF THE PREFERRED EMBODIMENTS

Figure 1:
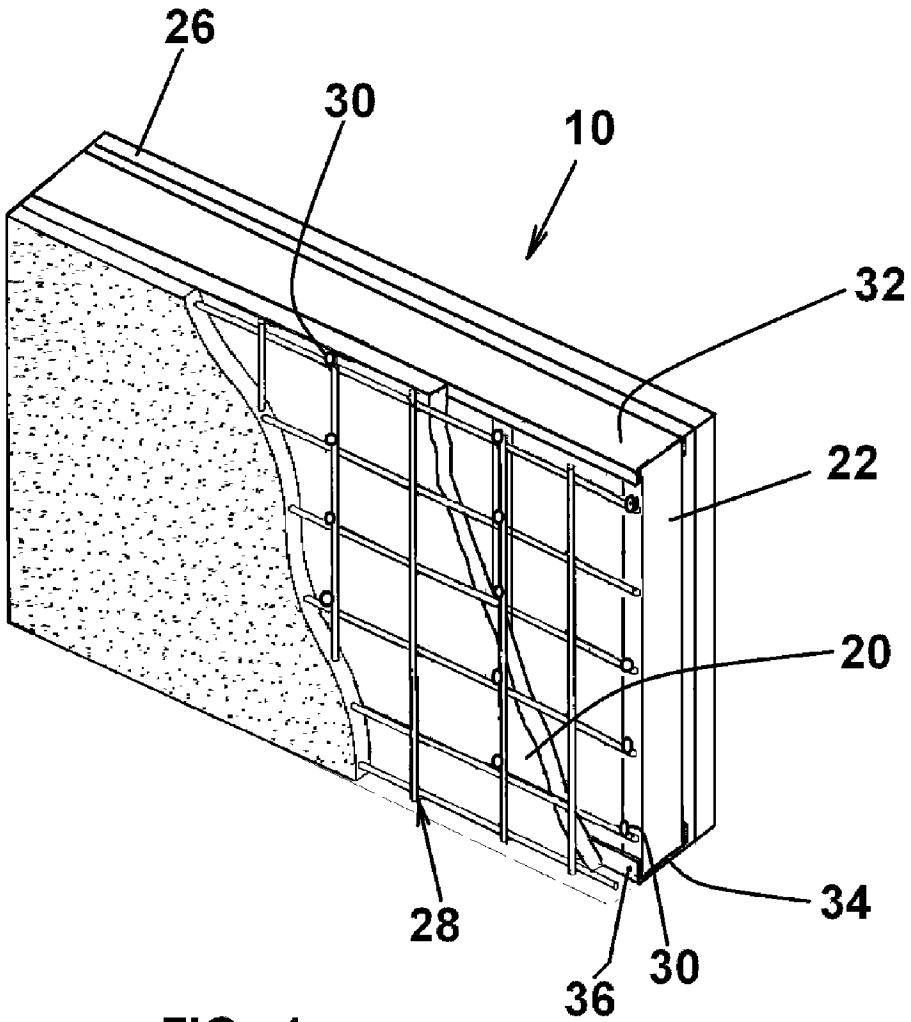
FIG. 1 is a partially sectioned perspective view of a concrete composite wall panel in accordance with an embodiment of the invention.
Figure 2:
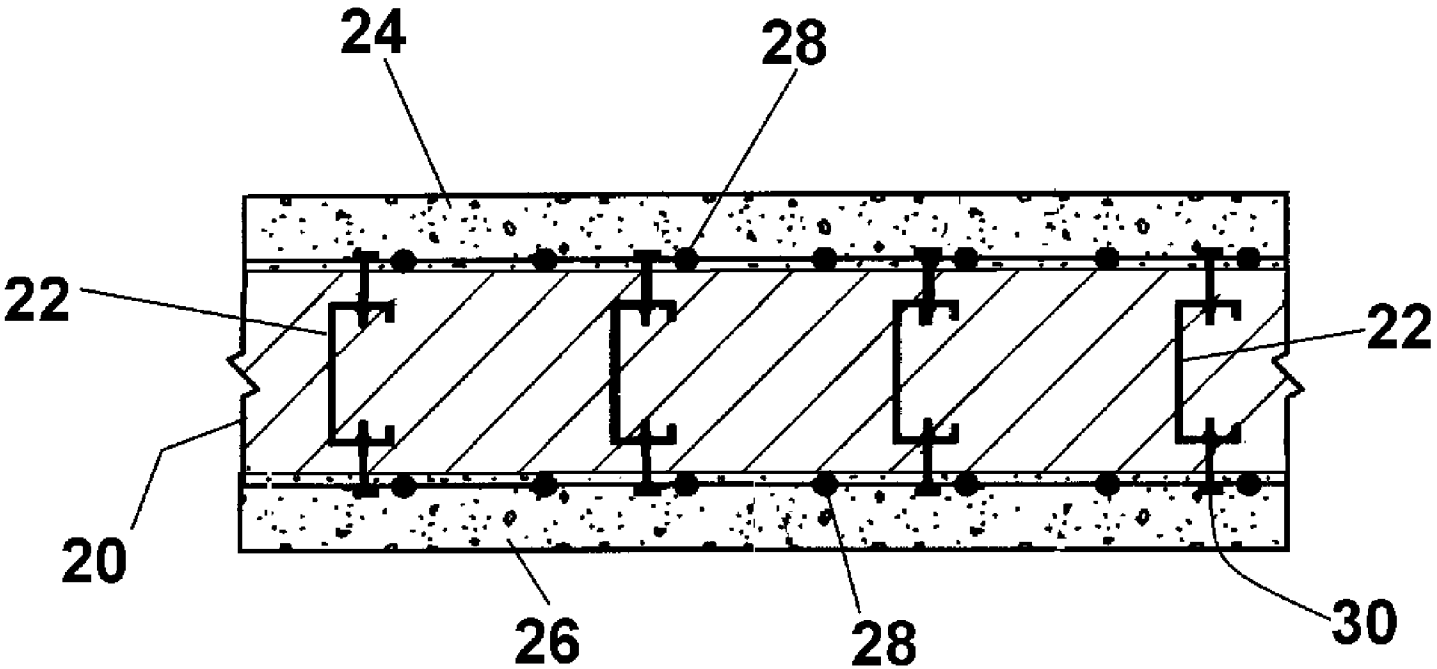
FIG. 2 is a horizontal cross sectional view of the wall panel of FIG. 1.
Figure 3:
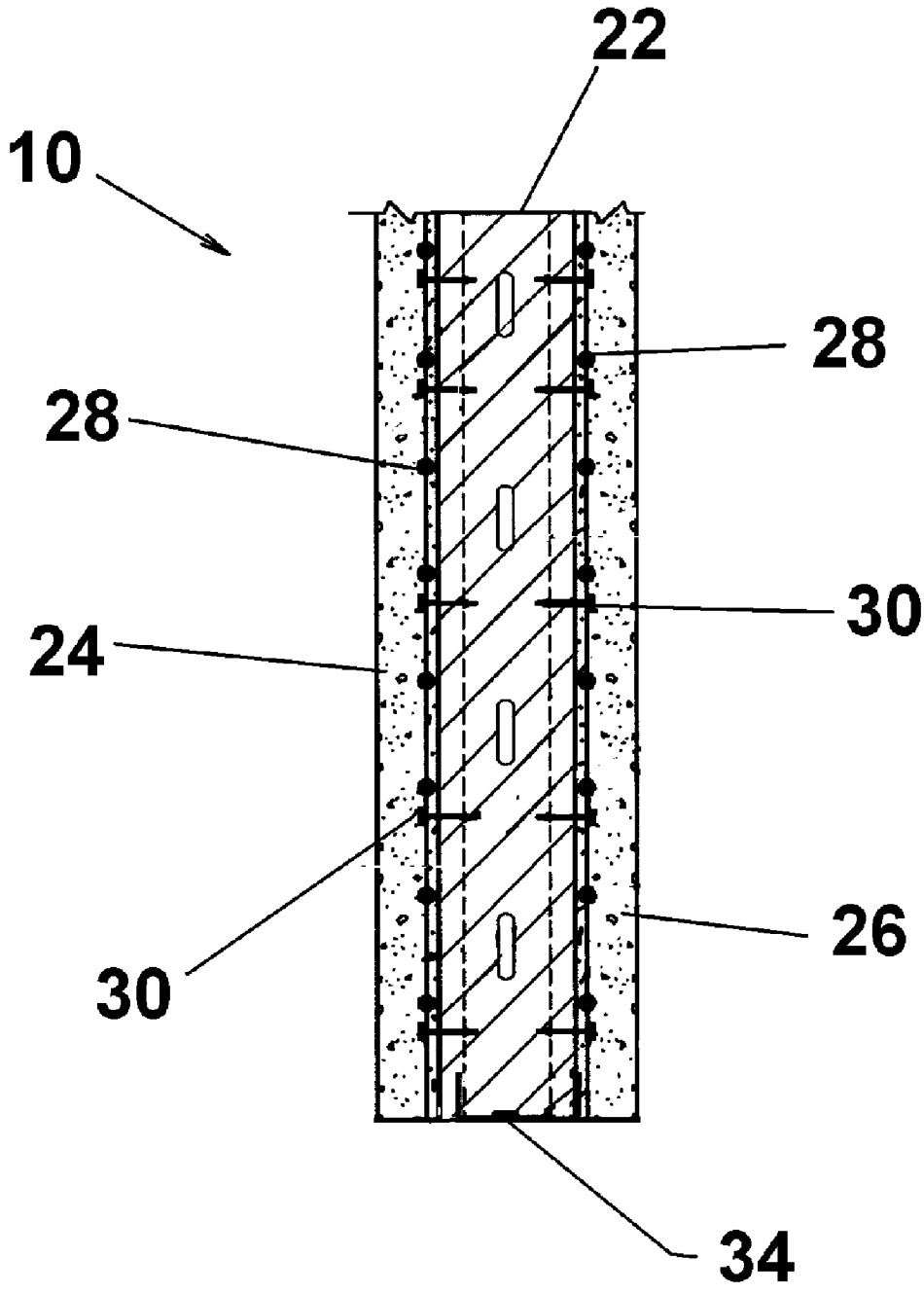
FIG. 3 is a vertical cross section of the wall panel of FIG. 1.
Figure 7:
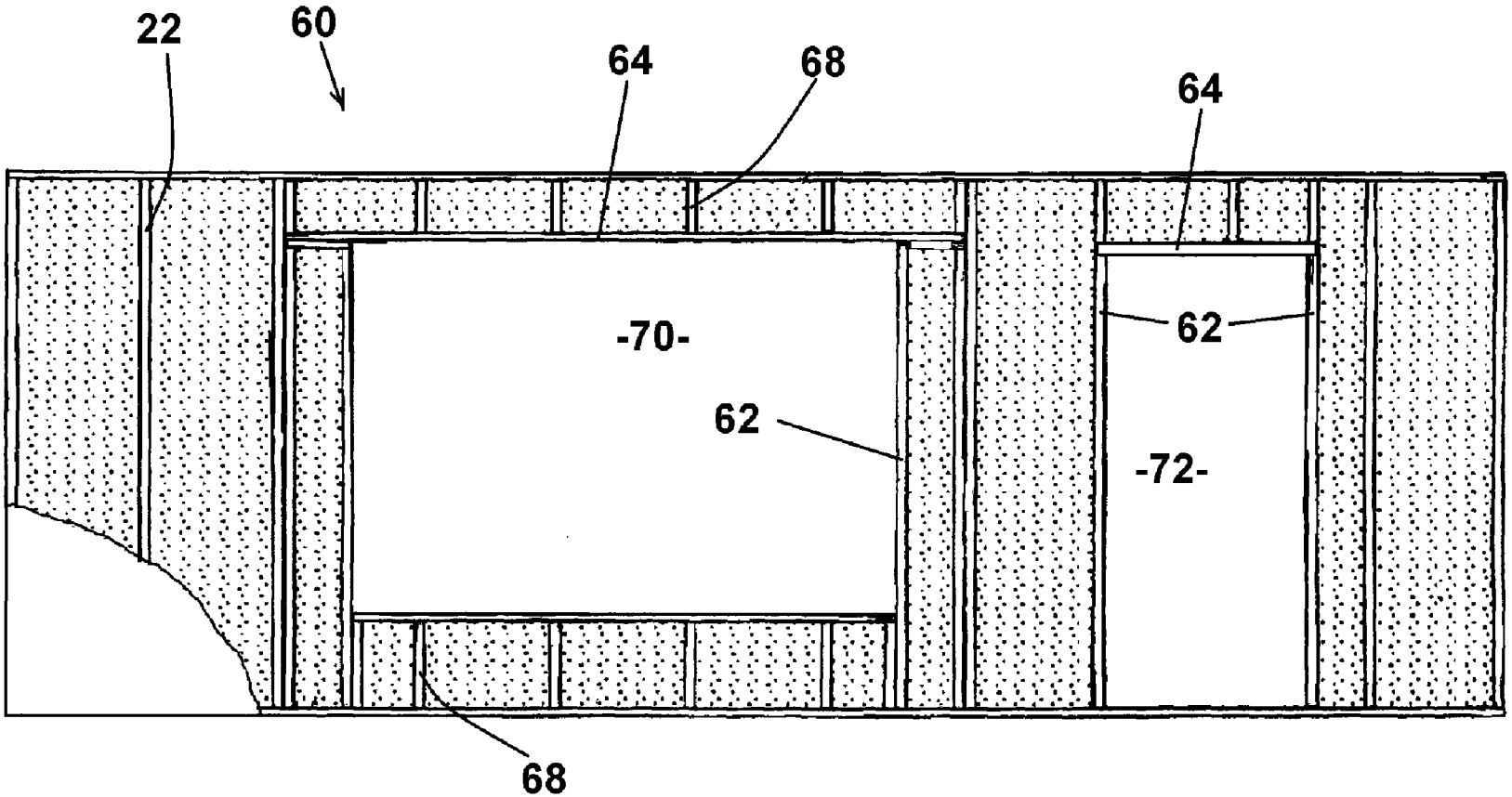
FIG. 7 is a partially sectioned elevational view of the wall panel in an exterior wall.

Referring to FIG. 1, there is shown a concrete composite wall panel 10 for an exterior wall of a structure, such as a residential or commercial building. As described below, the panel 10 is assembled with other panels to form the perimeter of the structure. These panels are provided with openings for doors, windows and the like as shown in FIG. 7 as described below. The panels may be of varying width, typically in 2 or 4 foot increments, and assembled at conventional joints to adjacent panels to form an extended wall section.

The composite panel 10 comprises a foam insulation core 20 carrying vertical support members such as C-studs 22 in internal pockets and having precast exterior and interior concrete facings 24, 26, respectively, bonded on the outer surfaces and anchored in a wire mesh 28 attached to the studs 22 by fastener assemblies 30. The panels are laterally placed side to side and interconnected with upper and lower U-shaped channel or tracks 32, 34 retained in transversely spaced lateral slots in the core 20 and conventionally attached to the studs 22 by fasteners 36, such as self tapping screws.

The core 20 is a rectangular block of uniform thickness comprising a polymeric foam, preferably expanded polystyrene. The blocks are generally available in 4 foot widths with end panels cut to desired length for the intended wall section. The height of the block corresponds to the wall height and may be comprised plural vertical sections if required. The thickness of the block is selected, in combination with the composite components, to provide the desired load bearing and insulation properties. The thickness also preferably exceeds the transverse width of the studs such that the stud cross section is encased by the core material thereby providing thermal break at least on the exteriorly facing wall surface thereby reducing heating and cooling costs.

Figure 8:
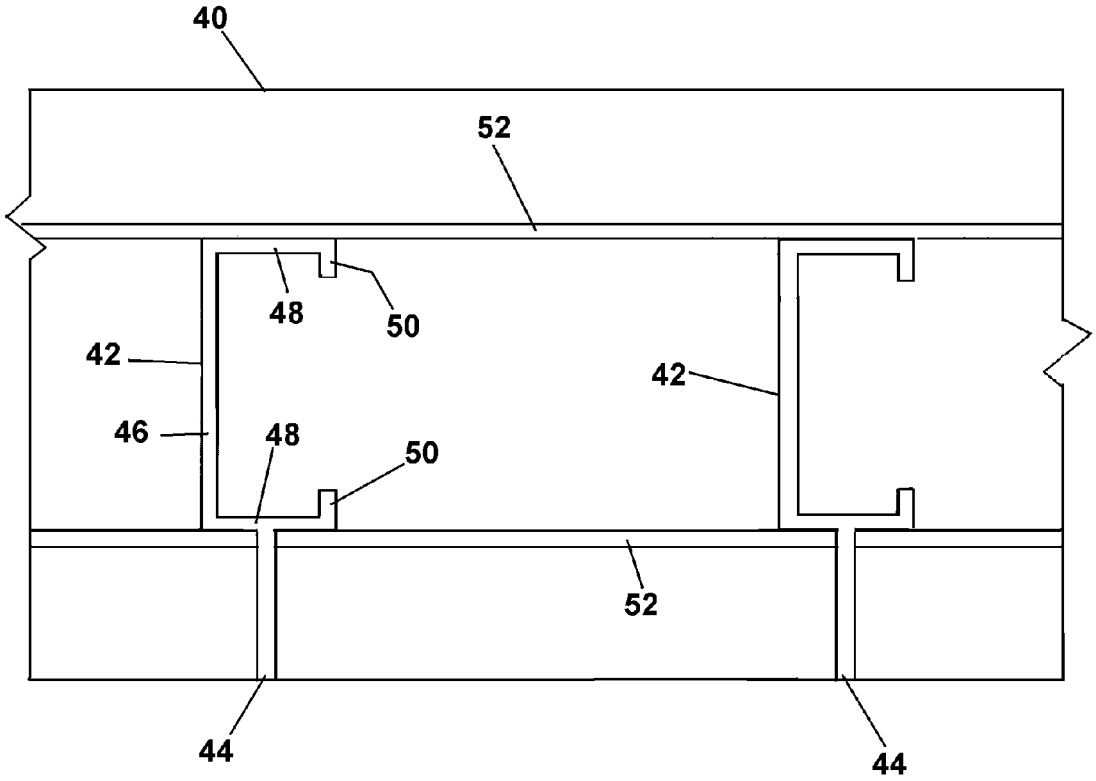
FIG. 8 is a fragmentary top view of the stud receiving slots in the foam core of the wall panel.

Referring to FIG. 8, each core panel 40 includes a vertical compound slot or pocket 42 of a configuration for slidably telescopically receiving the C-studs in a periodic lateral spacing in accordance with the wall specifications. Preferably, the slot 42 is formed by hot wire cutting for locally melting the core material during transit in a path corresponding to the stud cross section. Thus, the slot 42 includes a transverse entry leg 44, preferably on the interior surface of the core panel, intersecting the stud pattern at any desired transverse location. The hot wire is thereafter moved to form the web or base wall pocket 46 for the stud web or base, a pair of lateral side wall pockets 48 for the stud side walls or flanges, and tips or lip pockets 50 for the inwardly turned secondary flanges or lips of stud. The width of the pockets provides providing a sliding or light interference fit for the thickness of the studs for enable telescopic thereof into the core panel. Additionally, transversely spaced lateral slots 52 are formed in the top and bottom surfaces of the core panel 40 for receiving the legs of the tracks 32, 34 to a depth at least that of the legs. For exterior walls, depending on the loading, a 12 to 28 gage galvanized stud would be used with a base width of 2½ to 14 inches. The studs would be placed periodically at typical center-to-center lateral spacings of 16 or 24 inches. Jack studs would additionally be inserted at window and doors and the core material removed for the opening, which is finished with headers and cripple studs.

The load bearing design for the wall may be based on the accepted design specifications for the metal framed studs, without regard for the composite effects provided by the concrete and reinforcing mesh facings, and for the increased columnar strength of the studs embedded in the foam core. Testing is underway to determine the composite load bearing capabilities, and it is expected to demonstrate substantial increases that will allow the use of narrower and thinner studs.

The core panel 40 described above may be prepared and integrated into a preliminary wall panel of desired configuration as shown merely for example in FIG. 7 wherein a wall section 60 is formed of a plurality of panels and provided with supplemental jack studs 62, headers 64, sills 66 and cripple studs 68 to form a window 70 and a door 72 while retaining the desired periodic spacing the main studs 22.

Figure 6:
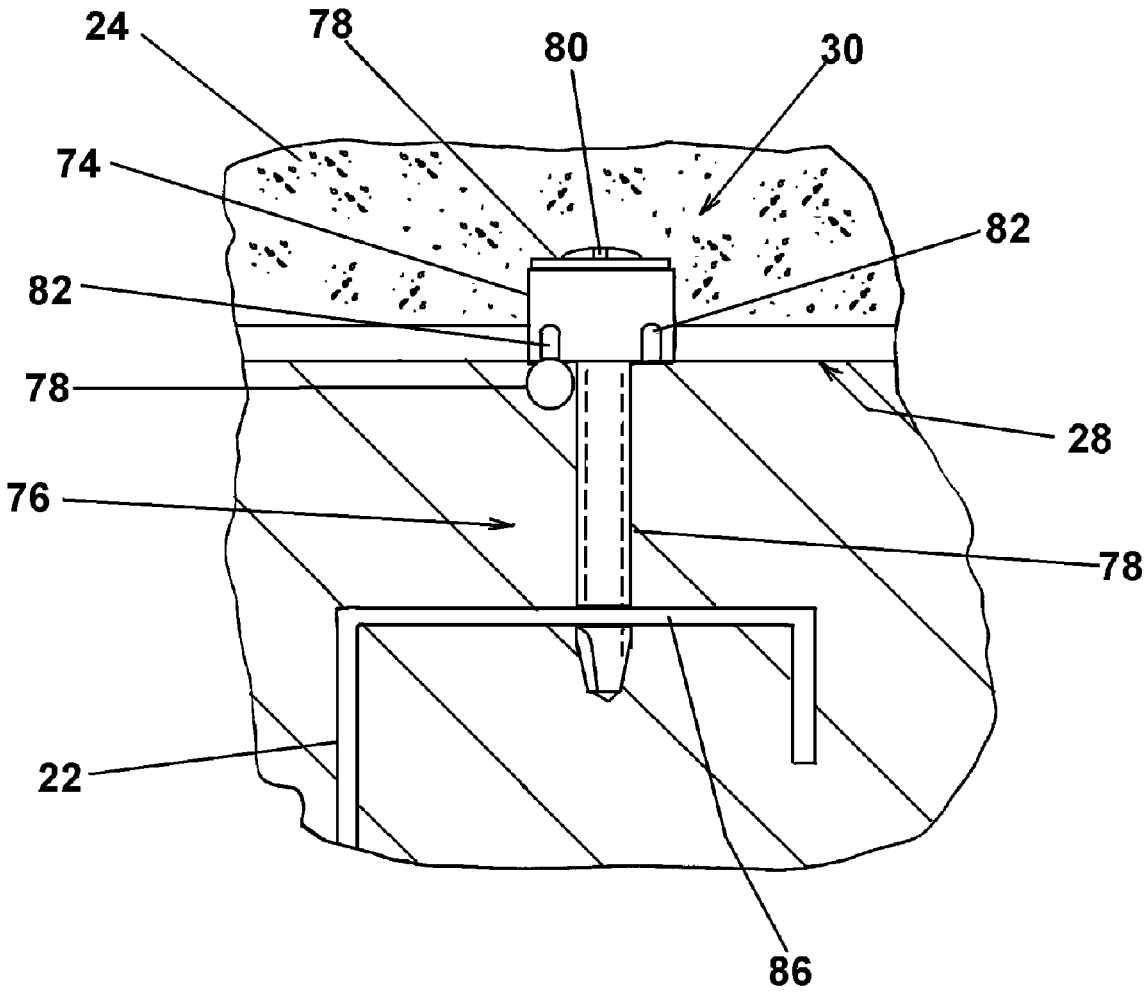
FIG. 6 is an enlarged fragmentary view of the fastener assembly for the reinforcing web for the composite wall panel.

Referring to FIGS. 1 and 6, after assembly of the wall section, the concrete reinforcing mesh is attached to the studs 22 and the tracks 32, 34 with the fastener assemblies 30. The fastener assemblies comprise a cylindrical washer or ferrule 74 with a self tapping screw 76 having a threaded shank 78 extending axially therethrough having an enlarged head 78 with a driver slot 80. The ferrule 74 includes symmetrical off center chordal slots 82. In assembly, one of the slots 82 is positioned over an available horizontal or vertical wire 84 of the mesh and the screw threaded with an appropriate tool through the core material into the side arm 86 of the C-stud, thereby fixedly locally securing the mesh. The reinforcing mesh may be welded or woven and available from a plurality of commercial sources. A galvanized mesh is preferred. Suitable fastener assemblies are available as furring screws from Flannery Fittings, Inc. The screws are torqued to securely fasten the mesh without substantial embedding of the mesh in the abutting surface of the foam core.

Thereafter, the wall section is placed on a work surface and the perimeter of the exterior surface walled with forms for retaining concrete to the desired thickness. The concrete is then applied to the core and finished to the desired thickness and texture. The thickness of the concrete may vary with the wall specifications, but should be sufficient to cover the mesh. A thickness of at least ½ inch is preferred. If a concrete facing is to be applied to the interior surface, after setting the exterior facing, the wall section is inverted and the process repeated. The concrete facings may be factory applied or applied at the construction site. The core assembly and concrete exterior provide substantial environmental protection against hurricane force winds and rain, seismic activity, as well as fire, mold, moisture and insect resistance.

Figure 4:
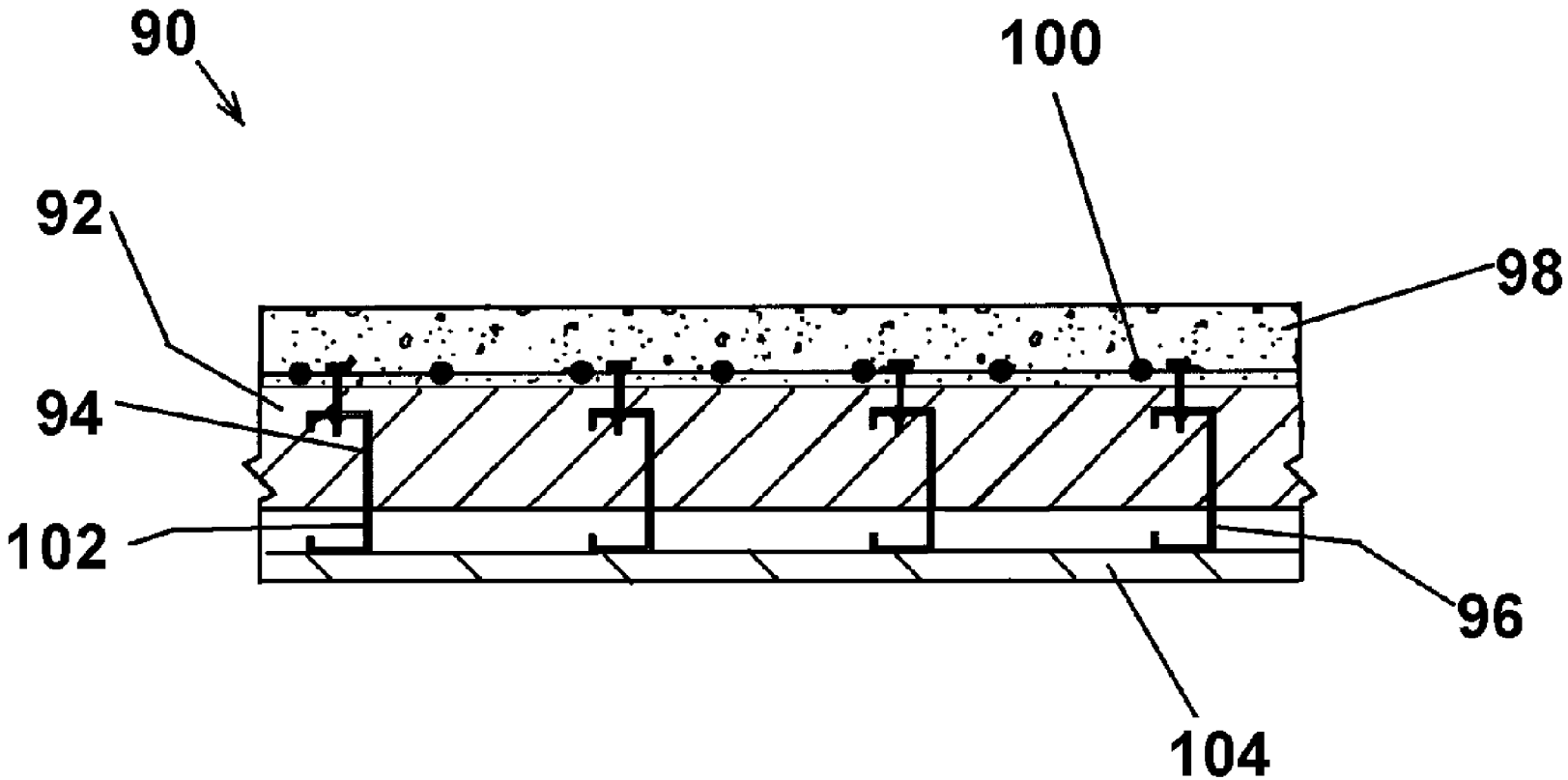
FIG. 4 is a horizontal cross sectional view of the wall panel in accordance with another embodiment of the invention.
Figure 5:
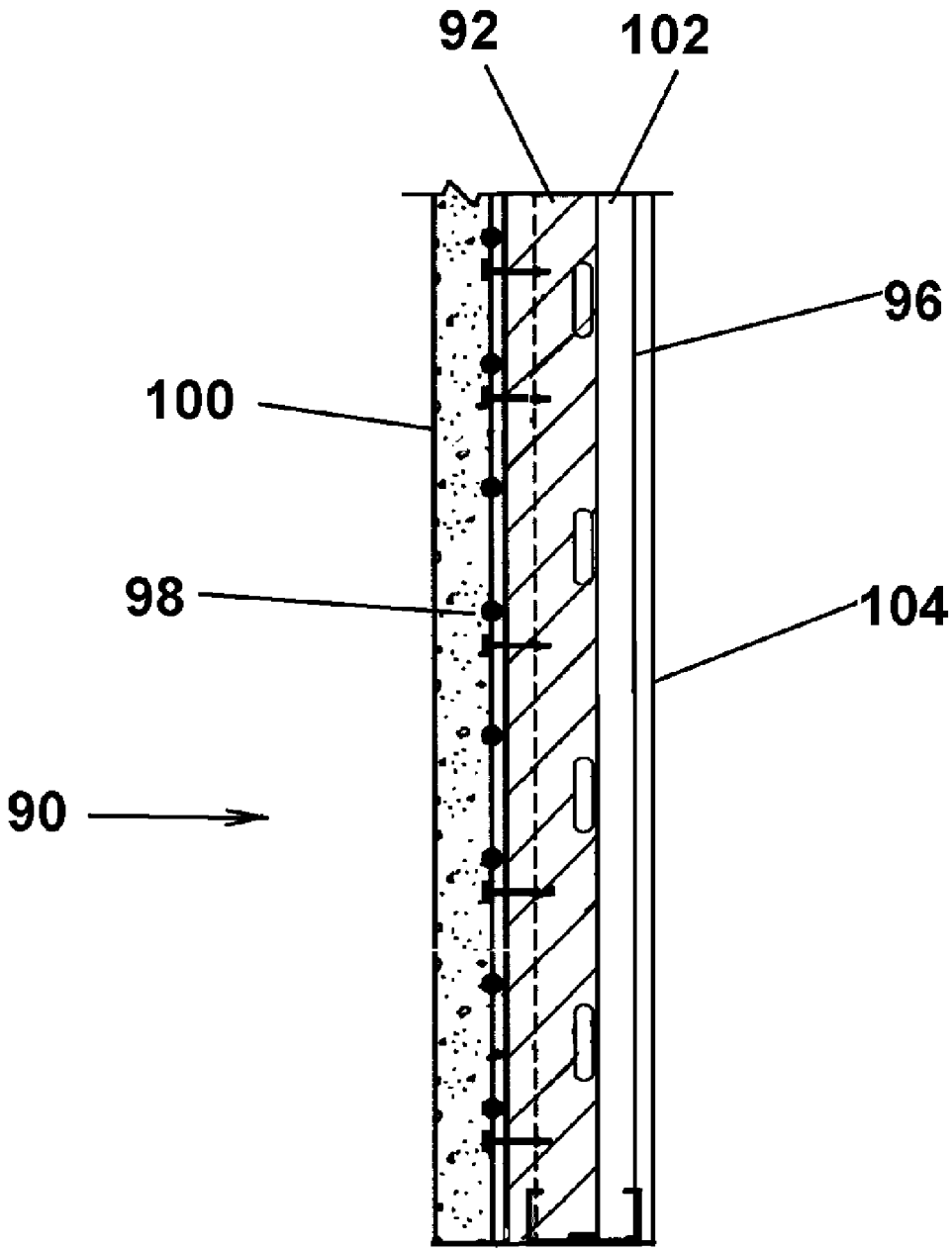
FIG. 5 is a vertical cross section of a wall system based on the wall panel of FIG. 4.

If a different facing is desired on the interior, such as wallboard or paneling, the interior concrete facing and associated mesh may be eliminated with the selected facing applied with suitable fasteners against the inner core surface and to the studs. Alternatively as shown in FIGS. 4 and 5, the panel 90 may have the thickness of the core 92 reduced and only the outer portion 94 of the studs 96 encased in vertical cross-sectionally conformal slots, with the exterior surface finished with the composite facing of concrete 98 and mesh 100 as described above. This inwardly exposes the inner side walls 102 of the studs for direct attachment of the interior facing 104 by suitable fasteners. The cavities between the studs may be filled with insulation.

It will thus be appreciated that the present invention has provided an improved composite wall panel wherein the studs embedded in the foam core and the composite concrete walls provide increased strength and insulation and resistant to environmental conditions, while utilizing conventional materials and building techniques.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed is:

1. A composite wall panel comprising:

a rectangular foam core having transversely spaced vertical interior and exterior planar surfaces, horizontally spaced vertical planar end surfaces and vertically spaced transverse upper and lower horizontal planar surfaces;

a plurality of C-studs, each of said studs characterized by a transverse base wall terminating at outer ends with lateral inner and outer side walls, said side walls terminating at outer ends with inwardly turned flanges;

a plurality of vertically extending slots formed in said foam core between said end surfaces, each of said slots having a transverse portion slidably engaging a portion of said base wall of a stud and an internal end section slidably engaging one of said flanges of said stud whereby a remaining portion of said base wall and the other of said flanges extends outwardly from said interior surface of said core; a reinforcing mesh on said exterior surface of said core and fastened to said flanges of said one of said studs;

upper and lower U-shaped track members each having a base and turned inner and outer legs, said bases engaging said top and bottom surfaces of said foam core, and said outer leg retained in a lateral slot in the top and bottom surfaces of said core adjacent said outer flanges of said studs and fastened thereto;

an outer facing of concrete material embedding said reinforcing mesh and bonded to said exterior surface of said core; and an inner wall panel fastened to said inner flanges of said stud.

2. The composite wall panel as recited in claim 1 wherein said foam core is comprised of a plurality of abutting lateral sections.

3. The composite wall panel as recited in claim 2 wherein said wall panel includes an opening partially framed by laterally spaced studs.

4. The composite wall panel as recited in claim 1 wherein said core is formed of an expanded polystyrene material.

5. The composite panel as recited in claim 4 wherein said slots are formed by locally melting said expanded polystyrene material.

* * * * *